US007080882B2

(12) United States Patent
Stitt

(10) Patent No.: US 7,080,882 B2
(45) Date of Patent: Jul. 25, 2006

(54) SEAT LOCK

(76) Inventor: Douglas Stitt, 107 King Henry Ct., Palantine, IL (US) 60067

( * ) Notice: Subject to any disclaimer, the term of this patent is extended or adjusted under 35 U.S.C. 154(b) by 0 days.

(21) Appl. No.: 11/011,592

(22) Filed: Dec. 14, 2004

(65) Prior Publication Data

US 2006/0138818 A1 Jun. 29, 2006

(51) Int. Cl.
*A47C 31/00* (2006.01)

(52) U.S. Cl. ..... 297/217.3; 297/335

(58) Field of Classification Search ..... 297/217.3, 297/335, 331, 463.2, 463.1, 378.12; 70/261
See application file for complete search history.

(56) References Cited

U.S. PATENT DOCUMENTS 1,429,057 A * 9/1922 Allen et al. ..... 116/200
2,359,254 A * 9/1944 Silver ..... 200/61.58 R
2,479,361 A * 8/1949 Hower ..... 297/217.1
5,415,458 A * 5/1995 Kim ..... 297/378.14
5,529,372 A * 6/1996 Cohen ..... 297/217.3
5,562,325 A * 10/1996 Moberg ..... 297/378.13
6,074,009 A * 6/2000 Farino ..... 297/378.14
6,179,381 B1 * 1/2001 Gevaert ..... 297/217.3
6,238,002 B1 * 5/2001 Brewer et al. ..... 297/411.32
6,431,572 B1 * 8/2002 Harden et al. ..... 280/250.1
6,769,738 B1 * 8/2004 Rivera et al. ..... 297/232
2002/0121974 A1 * 9/2002 Ohara ..... 340/542

* cited by examiner

*Primary Examiner*—Milton Nelson, Jr.
(74) *Attorney, Agent, or Firm*—Factor & Lake, Ltd.

(57) ABSTRACT

An apparatus is disclosed for inhibiting an unauthorized person from occupying a seat. According to one aspect, a lock is operatively attached to the seat of a foldable chair to prevent unfolding of the chair. Further, the lock allows the chair to unfold upon obtaining an input code that matches an unlock code.

According to another aspect, a blocking member is positioned to block a person from comfortably sitting in a chair. The blocking member can be repositioned to unblock the person from comfortably sitting in the chair upon obtaining an input code that matches an activation code.

16 Claims, 3 Drawing Sheets

SEAT LOCK

FIELD OF THE INVENTION

The present invention relates to seat locks, and in particular to a seat lock that inhibits an unauthorized person from occupying a seat.

RELATED APPLICATIONS

None.

FEDERALLY SPONSORED RESEARCH OR DEVELOPMENT

None.

BACKGROUND OF THE INVENTION

At public events there are seats, or areas of seats, reserved for specific ticket holders. Many of these seats, if not all, are not secured to prevent a person from occupying a seat reserved for another. Thus, the actual ticket holder is put in the uncomfortable position of having to confront the person occupying the seat, and asking him or her to move.

The unique invention disclosed herein provides a solution to inhibit an unauthorized person from occupying a seat.

SUMMARY OF INVENTION

The present invention is directed to a device that inhibits an unauthorized person from occupying a seat. According to one aspect of the invention, a lock is operatively attached to the seat and back of a foldable chair to prevent unfolding of the chair. Further, an electronic means is operatively coupled to the lock wherein the lock allows the chair to unfold upon obtaining an input code that matches an unlock code.

According to another aspect of the invention, a blocking member is positioned to block a person from sitting in a chair. Further, an electronic means is provided for allowing, upon activation, the blocking member to be repositioned to unblock the person from sitting in the chair. The electronic means can be activated upon obtaining an input code that matches an activation code.

Other embodiments, systems, methods, features, and advantages of the present invention will be, or will become, apparent to one having ordinary skill in the art upon examination of the following drawings and detailed description. It is intended that all such additional systems, methods, features, and advantages included within this description be within the scope of the present invention, and be protected by the accompanying claims.

DESCRIPTION OF THE DRAWINGS

The invention may be better understood with reference to the following drawings. The components in the drawings are not necessarily to scale, emphasis instead being placed upon illustrating the principles of the invention. In the drawings, like reference numerals designate corresponding parts throughout the several views.

DESCRIPTION OF DETAILED EMBODIMENTS

The following descriptions of detailed embodiments are for exemplifying the principles and advantages of the inventions claimed herein. They are not to be taken in any way as limitations on the scope of the inventions.

In the FIGURES, the following reference numbers are used to depict corresponding elements wherein reference numbers having the same last two digits correspond to like elements:

| Reference Number | Element |
|---|---|
| 10 | foldable chair |
| 12 | locking system |
| 14 | chair seat |
| 16 | chair back |
| 18 | biasing mechanism |
| 20 | frame or support |
| 22 | lock |
| 24 | latch or catching mechanism |
| 26 | attachment member or arm |
| 28 | electronic reader (electronic means) |
| 30 | bore or notch |
| 31 | bore or notch |
| 32 | catching mechanism housing |
| 34 | bore extending through housing |
| 36 | solenoid (electronic means) |
| 38 | pin |
| 40 | signal path |
| 42 | microcontroller (electronic means) |
| 44 | memory |
| 50 | armrest |
| 52 | armrest |
| 54 | blocking member or barrier |
| 56 | rectangular panel |
| 58 | biasing member |
| 60 | magnetic strip or bar code |
| 62 | ticket |

As used herein and in the claims, the term "electronic means" includes structure comprising at least one of the following: an electronic reader, a solenoid, and/or a microcontroller.

Figure 1:
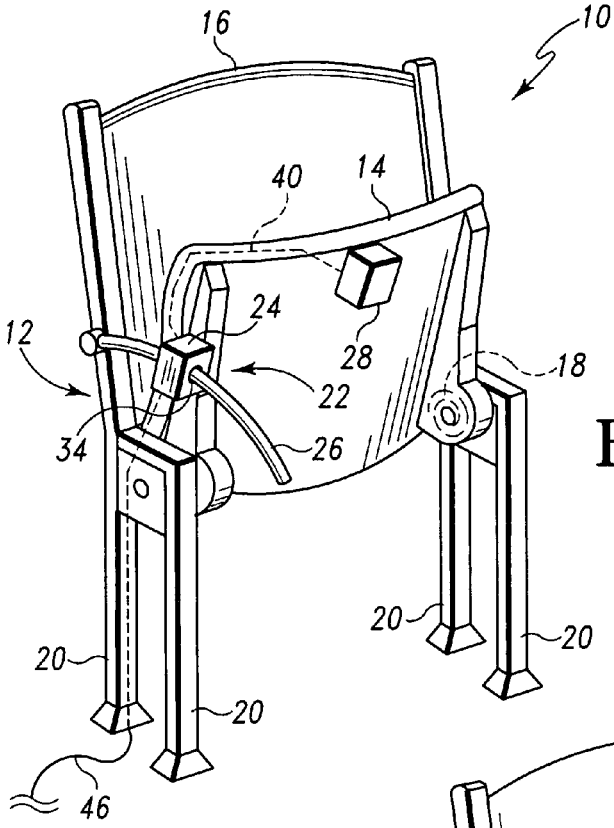
FIG. 1 is a perspective view of a foldable chair in a closed position with an apparatus in accordance with the present invention attached thereto.
Figure 2:
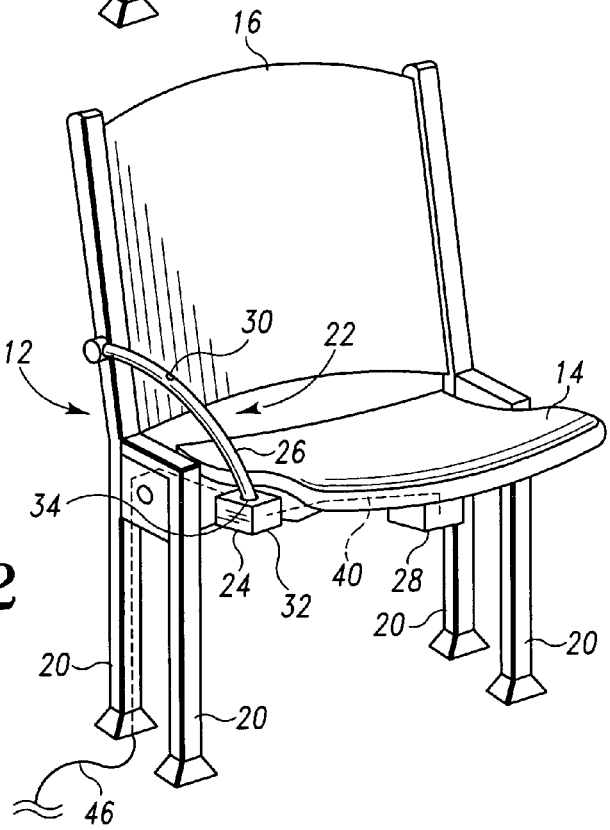
FIG. 2 is the chair of FIG. 1 with the foldable chair in the open position.

Turning to FIGS. 1 and 2, a foldable chair 10 is depicted having a locking system 12 in accordance with the present invention. The chair 10 includes a seat 14, a back 16, a conventional biasing mechanism 18, and support or frame 20. The frame 20 can include a plurality of legs attached to a fixed surface such as a floor or other fixed structure. The seat 14 and the back 16 of the chair 10 are operatively attached to the frame 20 in a conventional manner whereby, when the folding seat is opened (FIG. 2), the seat provides a platform for a person to sit and the back provides the sitting person with back support. Likewise, when the chair 10 is closed (FIG. 1) the seat 14 and the back 16 approach each other so that the seat 14 is not readily assessable for sitting.

The chair 10 can be installed or mounted in a stadium, arena, theater, or other venue wherein seats are leased for attending an event. Typically, but not necessarily, the patrons purchase a ticket for the event with the location of the seat printed on the ticket.

The biasing mechanism 18 is operatively attached in a conventional manner to the seat 14 to move the seat towards the back 16, and thus into the closed position (i.e., FIG. 1) when the seat is not occupied. The biasing mechanism 18 can comprise a spring or other conventional means for biasing the chair into a closed position when it is not occupied.

In an embodiment, the locking system 12 includes a lock 22 and an electric reader 28. The lock 22 includes a latch or catching mechanism 24 and an attachment member or arm 26. Preferably, but not necessarily, the catching mechanism 24 is attached (e.g., bolts, rivets or other conventional means) to the seat 14 and the attachment member 26 is attached (e.g., bolts, rivets or other conventional means) to the back 16 or frame 20. The attachment member 26 can be a straight or curvilinear bar or rod with a notch or bore 30 for receiving a locking pin 38 (FIG. 5) as described below.

Figure 5:
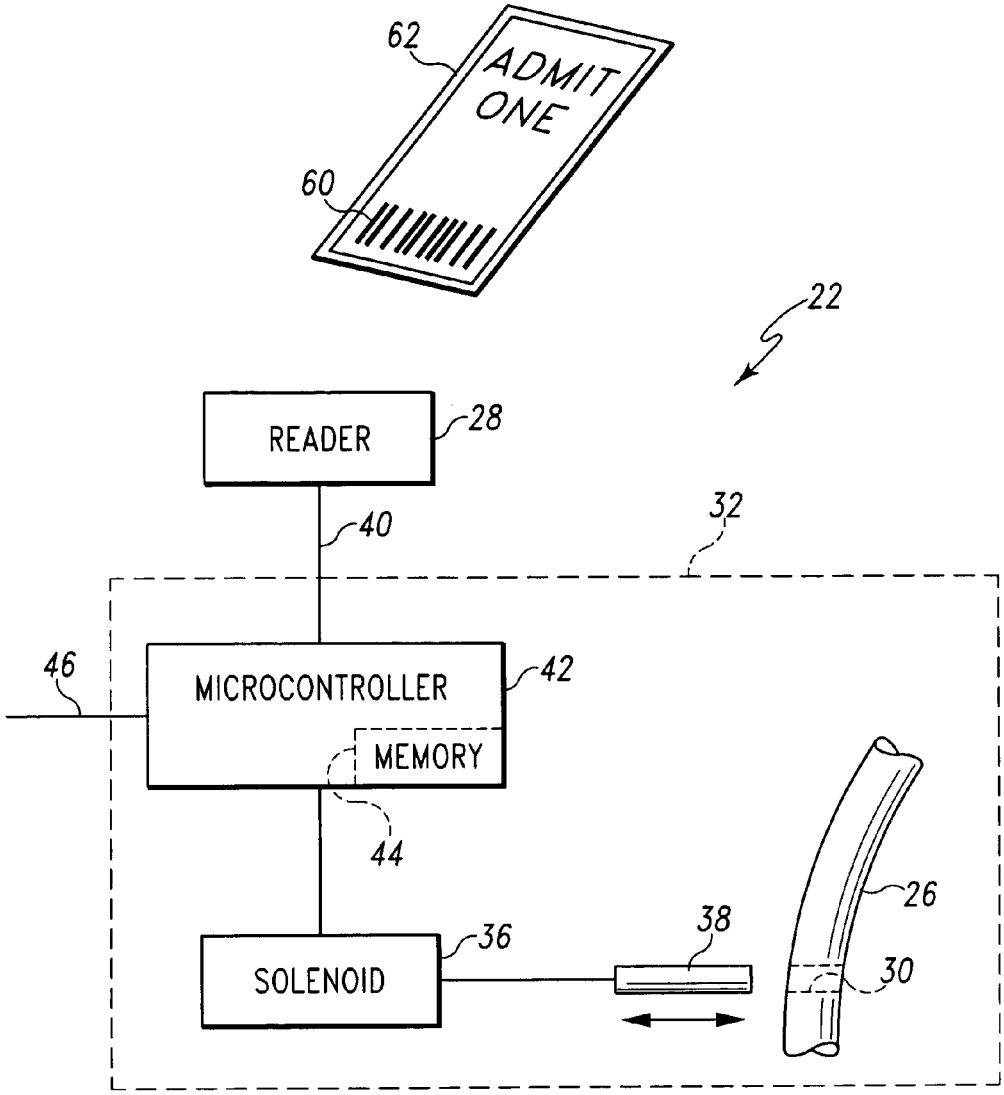

Accordingly, the locking mechanism 24 includes a metal or metal alloy housing 32 with a bore 34 extending therethrough. Turning to FIG. 5, also contained within the housing 32 is a solenoid 36 and a pin 38 or the like that is received within the notch 30 of the attachment arm 26 when the chair is in a locked position. The solenoid 36 is operatively coupled to the pin 26 for moving the pin 38 into, and out of, engagement with the notch 30 in the attachment arm, and thus locking and unlocking the position of the seat 14.

Preferably, but not necessarily, the reader 28 can be a conventional bar code reader, magnetic strip reader, or radio frequency identification (RFID) reader. The reader 28 can be connected to the chair 10, such as the underneath portion of the seat 14 by conventional means such as, but not limited to, bolts or rivets. The reader 28 is operatively connected to the lock 22 by a signal path 40 for providing a signal to the lock that contains the data (i.e., input code) read by the reader from a magnetic strip or bar code 60 located on a ticket 62 or from an RFID tag (not shown).

In an embodiment, the lock 22 can include a microcontroller 42 or other computer means for comparing the input code, read from the ticket, with an access code. Accordingly, the microcontroller can have a non-volatile memory 44 for storing the access code. If the input code matches the access code, then the microcontroller 42 sends a signal to unlock the lock wherein the pin 38 is removed from the bore 34 in the attachment member or arm 26. Thus, when the lock is unlocked, the chair 10 can be unfolded and the seat occupied.

The microcontroller 42 can be operatively connected to a remote computer (not shown) or the like, via a signal path 46. In an embodiment, the central computer can remotely unlock, lock, and change the access code stored by the lock memory 44. In yet another embodiment, the microcontroller 42 can be replaced by the central computer wherein the central computer receives the input code from the reader 28, compares the input code to an access code for the chair 10, and sends a command to unlock the chair if the input code read from the ticket 62 matches the access code for the chair.

In another embodiment, the chair 10 can receive a signal from a remote computer to unlock the chair once the corresponding ticket holder has entered the venue (i.e., stadium, arena, theater, or other venue wherein seats are leased for attending an event). Accordingly, an electronic reader can be located at an entrance to the venue wherein, upon reading the seat location of the ticket holder, a signal is generated to unlock the chair 10 associated with the ticket holder.

As will be appreciated by those having ordinary skill in the art, the electronics mounted to or about the chair are powered by an alternating current source, a solar energy cell mounted to the seat and/or back of the chair, a battery, or the like.

Figure 3:
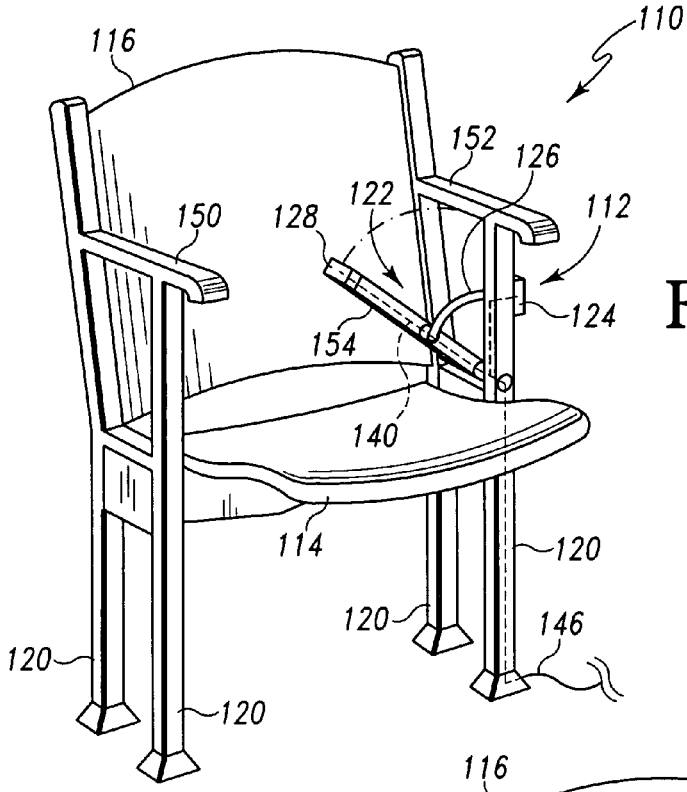
FIG. 3 is a perspective view of another embodiment of a chair having an apparatus in accordance with the present invention attached thereto in an extended state.
Figure 4:
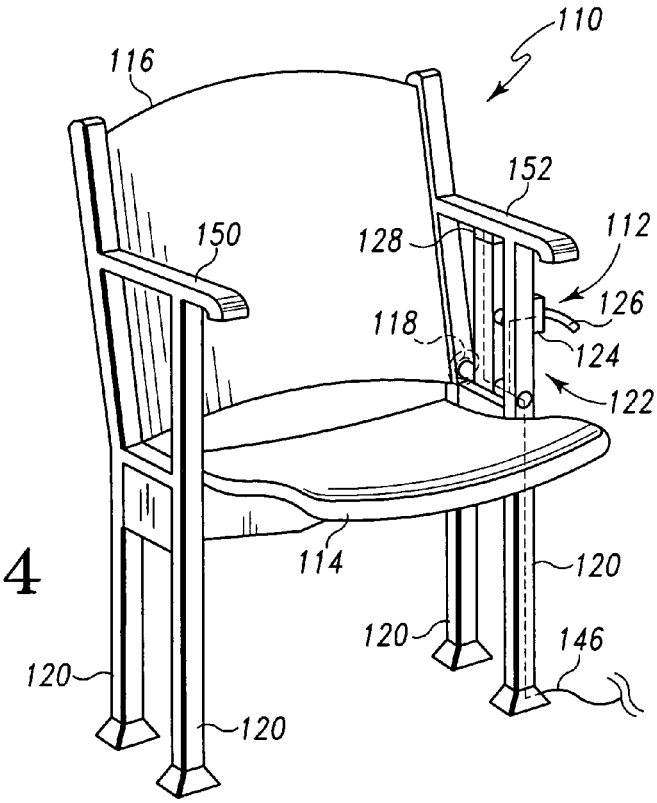
FIG. 4 is the chair of FIG. 3 with the apparatus in accordance with the present invention in a retracted state; and, FIG. 5 is a simplified partial schematic diagram of a locking system in accordance with the present invention.

Turning to FIGS. 3–4, another embodiment of a chair 110 is depicted having an apparatus 112 in accordance with the present invention attached thereto. The chair 110 includes a seat 114, a back 116, and armrests 150 and 152. In an embodiment, the seat 114 and back 116 are fixedly secured in relation to each other in a conventional manner. Accordingly, the seat 114 provides a platform for a person to sit and the back 116 provides the sitting person with back support. Moreover, the armrests 150,152 provide support for the sitting person's arms.

The locking system 112 includes a lock 122, an electronic reader 128, and a blocking member or barrier 154. In an embodiment, the blocking member 154 is a rectangular panel that is pivotally mounted to the chair 110 about the seat 114 and one of the armrests 150,152.

Preferably, the blocking member 154 can pivot such that in one position (FIG. 3), the blocking member 154 prevents the seat 116 from being readily assessable for sitting. Likewise, when the blocking member 154 is pivoted to another position (FIG. 4), the seat 114 is readily accessible. A coil spring 118 or other biasing means is provided to urge the blocking member into the position shown in FIG. 3.

The lock 122 includes a latch or catching mechanism 124 and an attachment member or arm 126. Preferably, but not necessarily, the catching mechanism 124 is fixedly secured to the seat, armrest, and/or frame 120 of the chair. The attachment member 126 is attached to the blocking member 154 and can be a curvilinear metal, or metal alloy, rod or strip having one or more openings or notches for mating with a locking pin 38 (FIG. 5) as described in detail further herein.

Accordingly, the catching mechanism 124 includes a housing 132 containing a solenoid 36 (FIG. 5) and a pin 38 (FIG. 5) that can be received within the opening 30 (FIG. 5) in the attachment member or arm 126. Further, the solenoid 36 is operatively coupled to the pin 126 for moving the pin 38 into, and out of, engagement with the opening in the attachment arm 126.

In an embodiment, the reader 128 is attached to the non-pivoting end of the blocking member 154. As stated previously, the reader 128 can be a conventional bar code reader, magnetic strip reader, or radio frequency identification (RFID) reader. The reader 128 is operatively connected to the lock by a signal path 140 for providing a signal to the lock that contains the data (i.e., input code) read by the reader from a bar code or magnetic strip on a ticket or the like such as an RFID tag.

As stated previously, the lock 122 can include a microcontroller or other computer means for comparing the input code with an access code. Accordingly, the microcontroller can have a non-volatile memory for storing the access code. If the input code matches the access code, then the microcontroller sends a signal to unlock the lock wherein the pin 126 is removed from the opening 30 in the locking mechanism 124. Thus, when the lock is unlocked, the blocking member 154 can be moved to provide access to the seat. Further, when the blocking member 154 is moved out of the way, the microcontroller can command the pin 126 into another opening (not shown) in the attachment arm 126 to prevent the blocking member 154 from moving back into the extended state (i.e., the state depicted in FIG. 3).

It should be emphasized that the above-described embodiments of the present invention, particularly, any "preferred" embodiments, are possible examples of implementations merely set forth for a clear understanding of the principles of the invention. Many variations and modifications may be made to the above-described embodiment(s) of the invention without substantially departing from the spirit and principles of the invention. All such modifications are intended to be included herein within the scope of this disclosure and the present invention, and protected by the following claims.

What is claimed is:

1. An apparatus comprising:

a lock operatively attached to a chair to prevent unfolding of the chair;

an electronic means operative coupled to the lock wherein the lock allows the chair to unfold upon obtaining an input code that matches an unlock code; and, wherein the chair is installed within a stadium, arena or theater.

2. The apparatus of claim 1, the electronic means comprising a magnetic strip reader or a barcode scanner.

3. The apparatus of claim 1, the electronic means comprising a radio frequency identification reader.

4. The apparatus of claim 1, wherein the electronic means is connected to a remote computer for sending the input code.

5. The apparatus of claim 4, wherein the computer sends the input code upon receiving a signal from a venue entry point.

6. The apparatus of claim 5, wherein the venue entry point is an entrance to the stadium, arena, or theater.

7. The apparatus of claim 1, wherein the electronic means is powered by an alternating current source, solar energy, or a battery.

8. An apparatus to prevent a person from comfortably sitting comprising:

a blocking member positioned to block the person from comfortably sitting in a chair having a seat;

an electronic means for allowing, upon activation, the blocking member to be repositioned to unblock the person from comfortably sitting in the seat, the electronic means being activated upon obtaining an input code that matches an activation code; and, wherein the chair is installed in a stadium, arena or theater.

9. The apparatus of claim 8, the blocking member comprising an armrest.

10. The apparatus of claim 8, the blocking member comprising a retractable bar.

11. The apparatus of claim 8, the electronic means comprising a magnetic strip reader, a barcode scanner, or a radio frequency identification reader.

12. The apparatus of claim 8, wherein the electronic means is connected to a remote computer for sending the input code.

13. The apparatus of claim 12, wherein the computer sends the input code upon receiving a signal from a venue entry point.

14. The apparatus of claim 13, wherein the venue entry point is an entrance to the stadium, arena, or theater.

15. The apparatus of claim 8, wherein the electronic means is powered by an alternating current source, solar energy, or a battery.

16. An apparatus comprising:

a lock operatively attached to a chair to inhibit occupancy of the chair when the lock is locked;

a reader for reading a code; and, wherein the lock is unlocked if the code is for unlocking the chair wherein the chair is installed in a stadium, arena or theater.

* * * * *